US009889651B2

(12) United States Patent
Norasak

(10) Patent No.: US 9,889,651 B2
(45) **Date of Patent: *Feb. 13, 2018**

(54) FLUID EJECTION DEVICE FOR DEPOSITING A DISCRETE QUANTITY OF FLUID ONTO A SURFACE

(71) Applicant: Funai Electric Co., Ltd., Osaka (JP)

(72) Inventor: Sam Norasak, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/672,662

(22) Filed: Mar. 30, 2015

(65) Prior Publication Data

US 2016/0288504 A1 Oct. 6, 2016

(51) Int. Cl.
*B41J 2/165* (2006.01)
*B41J 2/14* (2006.01)

(52) U.S. Cl.
CPC ..... *B41J 2/14145* (2013.01); *B41J 2/14016* (2013.01)

(58) Field of Classification Search
None
See application file for complete search history.

(56) References Cited

U.S. PATENT DOCUMENTS 5,371,527 A 12/1994 Miller et al.
5,933,172 A * 8/1999 Park ..... B41J 2/17509 347/85

(Continued)

FOREIGN PATENT DOCUMENTS

JP 2003290686 10/2003
JP 2007173399 7/2007

(Continued)

OTHER PUBLICATIONS

Non-Final Office Action, dated Apr. 8, 2016, for U.S. Appl. No. 14/672,672, filed Mar. 30, 2015.

(Continued)

*Primary Examiner* — Alejandro Valencia
(74) *Attorney, Agent, or Firm* — Amster, Rothstein & Ebenstein, LLP

(57) ABSTRACT

A fluid ejection device is disclosed that includes a body defining an interior bore, a fluid reservoir, and a fluid ejection chip. The fluid reservoir includes a wall and one or more fluid control surfaces disposed along an interior surface of the wall. The fluid reservoir defines an interior passage in fluid communication with the interior bore of the body. The fluid ejection chip is disposed on the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The interior passage of the fluid reservoir, the interior bore of the body, and the one or more interior fluid paths are axially aligned such that the fluid is gravity fed to the fluid ejection chip upon entry into the interior passage of the fluid reservoir. The one or more fluid control surfaces are disposed along the interior passage of the fluid reservoir so that the fluid adheres to the one or more fluid control surfaces.

20 Claims, 7 Drawing Sheets

(56) References Cited

U.S. PATENT DOCUMENTS

| | | | | |
|---|---|---|---|---|
| 6,776,479 | B2 * | 8/2004 | Ardito | B41J 2/17506 347/85 |
| 6,926,392 | B2 | 8/2005 | Sasaki et al. | |
| 7,364,267 | B2 | 4/2008 | Sasaki | |
| 8,443,985 | B2 * | 5/2013 | Aoyama | B41J 2/17563 210/257.1 |
| 2002/0015083 | A1 | 2/2002 | Thorpe et al. | |
| 2004/0217186 | A1 | 11/2004 | Sachs et al. | |
| 2004/0257412 | A1 | 12/2004 | Anderson, Jr. et al. | |
| 2005/0012791 | A1 | 1/2005 | Anderson et al. | |
| 2006/0227173 | A1 | 10/2006 | Buchanan et al. | |
| 2008/0117261 | A1 | 5/2008 | Silverbrook et al. | |
| 2013/0070021 | A1 * | 3/2013 | Nishimura | B41J 25/34 347/37 |
| 2013/0342618 | A1 | 12/2013 | Frasure et al. | |

FOREIGN PATENT DOCUMENTS

| | | |
|---|---|---|
| JP | 2009262057 | 11/2009 |
| JP | 2012086370 | 5/2012 |

OTHER PUBLICATIONS

Final Office Action, dated Aug. 11, 2016, for U.S. Appl. No. 14/672,672, filed Mar. 30, 2015.

Non-Final Office Action, dated Feb. 8, 2016, for U.S. Appl. No. 14/672,688, filed Mar. 30, 2015.

Final Office Action, dated Jun. 17, 2016, for U.S. Appl. No. 14/672,688, filed Mar. 30, 2015.

* cited by examiner

FLUID EJECTION DEVICE FOR DEPOSITING A DISCRETE QUANTITY OF FLUID ONTO A SURFACE

FIELD

This invention is related to fluid ejection devices, and in particular, to fluid ejection devices that minimize fluid waste.

BACKGROUND

In some applications, discrete quantities of fluid are deposited onto a surface, for example, pharmaceutical applications, chemical applications, industrial applications, and medical testing applications, to name a few. Accordingly, fluids may be transported from a fluid reservoir and applied to a target surface with a fluid applicator, such as, for example, a pipette or fluid dropper.

SUMMARY OF THE INVENTION

An object of the present invention is to provide a fluid ejection device for depositing predetermined quantities of fluid onto a target surface.

Another object of the present invention is to provide a fluid ejection device for ejecting a predetermined quantity of fluid while minimizing any remainder fluid to be stored in the fluid ejection device so that fluid waste is minimized.

In an exemplary embodiment, a fluid ejection device is disclosed that comprises a body defining an interior bore, a fluid reservoir, and a fluid ejection chip. The fluid reservoir comprises a wall and one or more fluid control surfaces disposed along an interior surface of the wall. The fluid reservoir defines an interior passage in fluid communication with the interior bore of the body. The fluid ejection chip is disposed on the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The interior passage of the fluid reservoir, the interior bore of the body, and the one or more interior fluid paths are axially aligned such that the fluid is gravity fed to the fluid ejection chip upon entry into the interior passage of the fluid reservoir. The one or more fluid control surfaces are disposed along the interior passage of the fluid reservoir so that the fluid adheres to the one or more fluid control surfaces.

In embodiments, the one or more fluid control surfaces protrude from the annular wall of the fluid reservoir.

In embodiments, the one or more fluid control surfaces are recessed into the annular wall of the fluid reservoir.

In embodiments, the one or more fluid control surfaces have a cross-sectional profile selected from the group comprising: rounded rectangular, curvate, pointed, and hook-shaped.

In embodiments, a surface of the annular wall of the fluid reservoir is coated with a hydrophilic substance.

In embodiments, at least a portion of the fluid reservoir protrudes from the body.

In embodiments, the one or more fluid ejection actuators are thermal ejection actuators.

In embodiments, the fluid ejection chip comprises a substrate, a flow feature layer disposed over the substrate, and a nozzle layer disposed over the flow feature layer.

In embodiments, the fluid ejection chip comprises a nozzle layer defining one or more nozzles.

In embodiments, the fluid reservoir widens in the direction of the body.

In embodiments, the one or more interior fluid paths are substantially linear.

In embodiments, the body comprises a surface feature for engagement by a user.

In an exemplary embodiment, a fluid ejection system comprises a fluid ejection printer and a fluid ejection device. The fluid ejection printer comprises a housing and at least one of an internal power source or one or more electrical contacts in electrical communication with an external power source. The fluid ejection device comprises a body defining an interior bore, a fluid reservoir, a fluid ejection chip, and an electrical connector. The fluid reservoir comprises a wall and one or more fluid control surfaces disposed along an interior surface of the wall. The fluid reservoir defines an interior passage in fluid communication with the interior bore of the body. The fluid ejection chip is coupled with the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The electrical connector is in electrical communication with the fluid ejection printer so that power is supplied from the fluid ejection printer to the fluid ejection chip. The interior passage of the fluid reservoir, the interior bore of the body, and the one or more interior fluid paths are axially aligned such that the fluid is gravity fed to the fluid ejection chip upon entry into the interior passage of the fluid reservoir. The one or more fluid control surfaces are disposed along the interior passage of the fluid reservoir so that the fluid adheres to the one or more fluid control surfaces.

In embodiments, the fluid ejection printer comprises a carrier for coupling with the fluid ejection device.

In embodiments, the carrier is moveable with respect to the housing of the fluid ejection printer.

In embodiments, the fluid ejection printer comprises a controller.

In an exemplary embodiment, a method of forming a fluid ejection device comprises: providing an elongate body defining an interior bore and comprising an engagement portion and an ejection portion, the ejection portion comprising a fluid reservoir extending at least partially through the body and defining an interior fluid channel in fluid communication with the interior bore of the body, the fluid reservoir comprising an annular wall and one or more fluid control surfaces disposed along an interior surface of the annular wall; and attaching a fluid ejection chip to the body so that an interior fluid path of the fluid ejection chip is axially aligned with and in fluid communication with the interior bore of the body and the interior fluid channel of the fluid reservoir.

In embodiments, the fluid ejection chip comprises one or more fluid ejection actuators.

In embodiments, the one or more fluid ejection actuators are thermal ejection actuators.

In embodiments, the one or more fluid control surfaces have a cross-sectional profile selected from the group comprising: rounded rectangular, curvate, pointed, and hook-shaped.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 2:
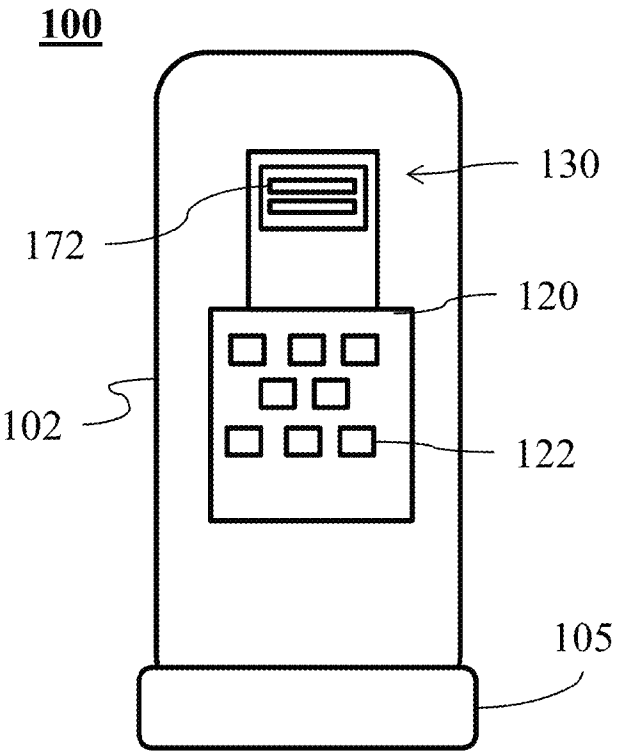
FIG. 2 is a bottom view of the fluid ejection device of FIG. 1.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 1:
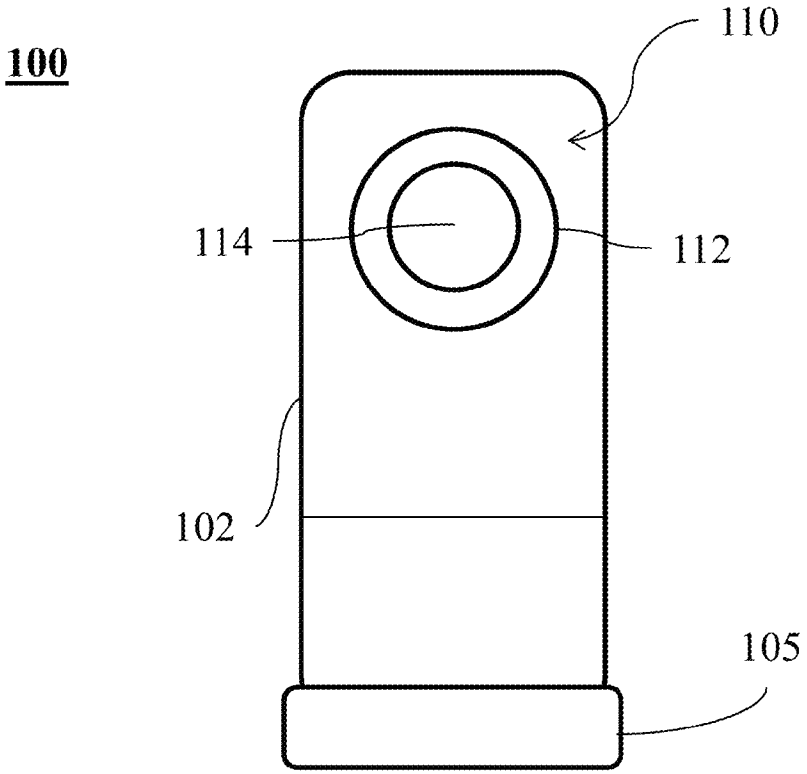
FIG. 1 is a top view of a fluid ejection device according to an exemplary embodiment of the present invention.
Figure 3:
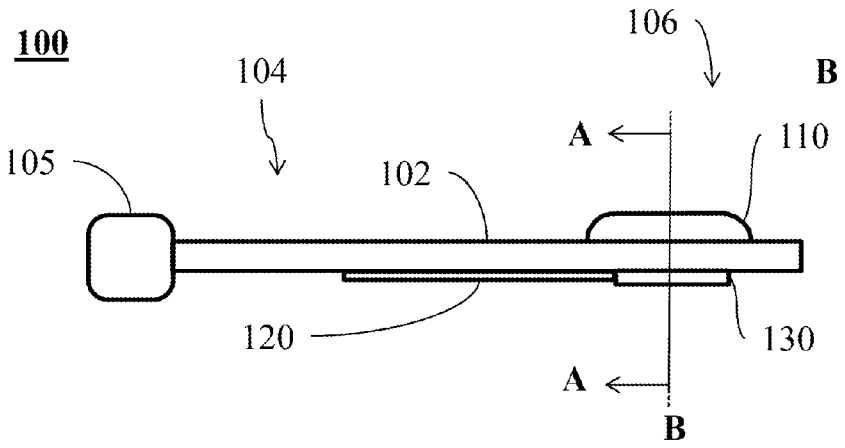
FIG. 3 is a side view of the fluid ejection device of FIG. 1.

Referring to FIG. 1, FIG. 2, and FIG. 3, a fluid ejection device according to an exemplary embodiment of the present invention is illustrated, and is generally designated 100. Fluid ejection device 100 includes a body 102 along which a fluid reservoir 110, an electrical connector 120, and a fluid ejection chip 130 are disposed.

Body 102 may be an elongate member that includes a user engagement portion 104 and an ejection portion 106. User engagement portion 104 may include a surface feature 105 (e.g., a knob, bump, or ledge) to provide a user or grasping tool with a recognizable and easily-grasped region for handling fluid ejection device 100.

Ejection portion 106 includes fluid reservoir 110, fluid ejection chip 130, and at least a portion of electrical connector 120, as described further herein. Body 102 may be formed of one or more suitable materials for applications described herein, for example, glass, polymeric materials, and composite materials, to name a few. In embodiments, user engagement portion 104 and/or ejection portion 106 may have different configurations.

As shown, electrical connector 120 extends along a portion of body 102 and is in electrical communication with fluid ejection chip 130 via one or more bond pads 122. Electrical connector 120 may be a tab automated bonded (TAB) circuit that includes electrical conductors (not shown) that can contact a portion of a fluid ejection system to provide electrical power for fluid ejection chip 130, as described further herein. In embodiments, electrical connector 120 may have a different configuration, for example, a configuration in which electrical connector 120 is interiorly disposed along at least a portion of body 102.

Fluid reservoir 110, as shown, protrudes from the surface of body 102 and includes an annular wall 112 that circumscribes an interior fluid channel 114 (FIG. 4) extending through fluid reservoir 110. Fluid reservoir 110 may have a hollow, dome-shaped profile as shown. Fluid reservoir 110 may be a separable component that is coupled to body 102, for example, by adhesion, welding, or mechanical coupling, to name a few. In embodiments, fluid reservoir 110 may be integrally formed with body 102. In embodiments, fluid reservoir 110 may have a different configuration, for example, a configuration in which fluid reservoir 110 is flush or recessed with the body 102 of fluid ejection device 100 and/or a configuration in which fluid reservoir 110 is not a curved structure.

Fluid ejection chip 130 is disposed along the body 102 of fluid ejection device 102 on an opposite side from fluid reservoir 110 such that one or more nozzles 172 of fluid ejection chip 130 are exposed facing a target surface upon which one or more fluids are to be deposited, for example, a testing slide or petri dish. As shown, fluid reservoir 110 and fluid ejection chip 130 are aligned along an axis B extending through fluid ejection device 100 such that a substantially linear and open fluid path is defined between the top of fluid reservoir 110 and nozzles 172 of fluid ejection chip 130, as described further herein. In this regard, fluids deposited into fluid reservoir 110 can be gravity fed to fluid ejection chip 130. In embodiments, fluid reservoir 110 may have a configuration such that a backpressure is provided to at least partially counteract the force of gravity on fluids deposited into fluid reservoir 110, e.g., to control a flow rate of fluid passing through fluid ejection device 100.

Figure 4A:
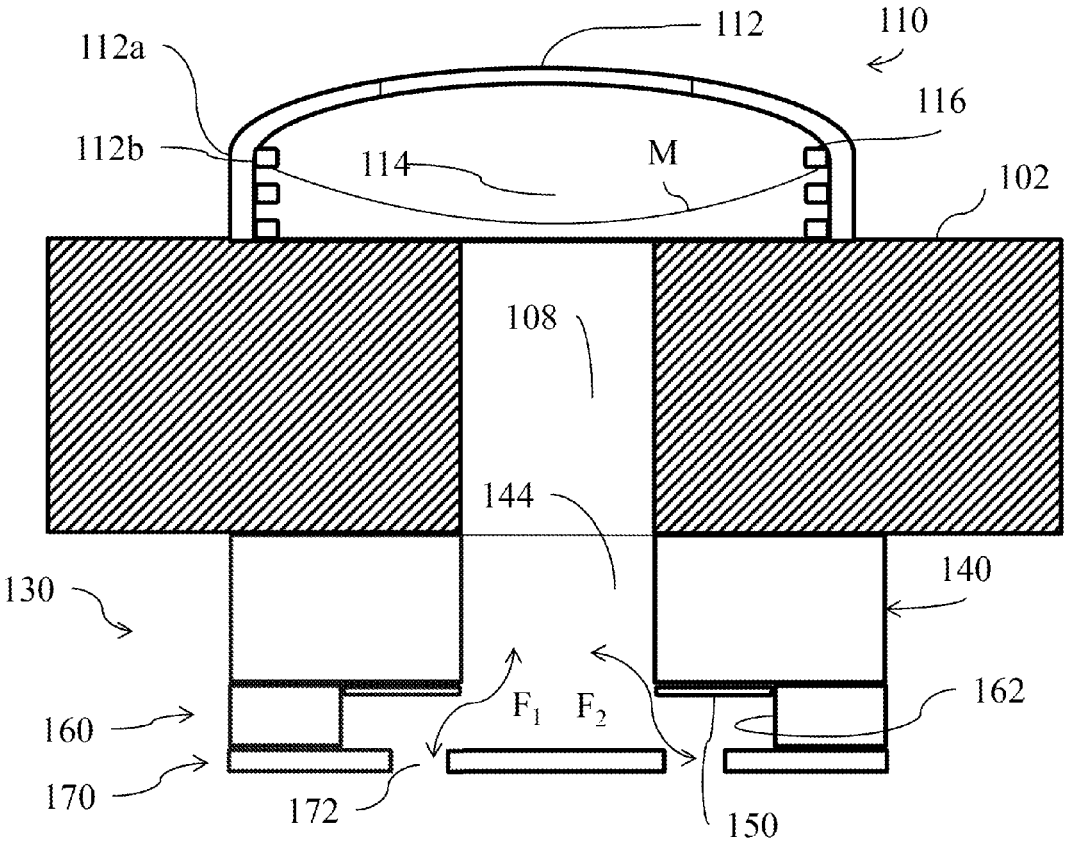
FIG. 4A is an enlarged cross-sectional view taken along the line A-A in FIG. 3.

Turning to FIG. 4A, an enlarged cross-sectional view of a portion of fluid ejection device 100 is shown, including fluid reservoir 110 and fluid ejection chip 130.

Annular wall 112, as shown, has an exterior surface 112*a* and an interior surface 112*b*. Accordingly, an interior diameter of fluid reservoir 110 can be measured between two diametrically opposed points on the interior surface 112*b* of annular wall 112. The interior diameter of fluid reservoir 110 may widen from a narrowest point at the top of annular wall 112 of, for example, between about 5 mm and 10 mm, to a widest point at the bottom of annular wall 112 of, for example, between about 15 mm and about 25 mm. In embodiments, fluid reservoir 110 may have an interior diameter that widens from 10 mm at the top of annular wall 112 to 18 mm at the bottom of annular wall 112. A height of fluid reservoir 110 can be measured between a vertically highest point and a vertically lowest point of annular wall 112. Fluid reservoir 110 may have a height of, for example, between about 3 mm and about 10 mm. In embodiments, fluid reservoir 110 may have a height of 5 mm. In embodiments, fluid reservoir 110 may be dimensioned to accommodate, for example, between about 1.8 $cm^3$ of fluid and about 4.1 $cm^3$ of fluid. In embodiments, fluid reservoir 110 may be dimensioned to accommodate about 0.5 grams of a water-based fluid. In this regard, the interior diameter and height of fluid reservoir 110 can be selected to provide a desired interior volume. In embodiments, fluid reservoir 110 may have a different configuration, e.g., an elliptical profile, a rectangular profile, a triangular profile, or a tapered profile such as a conical profile, to name a few.

As shown, fluid reservoir 110 includes a number of fluid control surfaces 116 disposed circumferentially around the interior surface 112*b* of the annular wall 112. Fluid control surfaces 116 may protrude at least partially into the interior fluid channel 114 such that fluid control surfaces 116 are disposed along a path that a fluid travels as it passes through fluid ejection device 100. Fluid control surfaces 116 may have a rounded rectangular profile in cross-section, as shown, or may have a different cross-sectional profile, as described further herein. In embodiments, fluid control surfaces 116 may integrally formed with the wall of fluid reservoir 110, e.g., may be molded with or cut from the annular wall 112 of fluid reservoir 110. In embodiments, fluid control surfaces 116 may be affixed to the interior wall of fluid reservoir 110, e.g., as an o-ring or circumferential clip.

Fluid control surfaces 116 are configured to contact and engage, e.g., through an adhesion between the fluid and the fluid control surface 116, fluids passing through the interior fluid channel 114. As shown, fluids passing by fluid control surfaces 116 may adhere to the fluid control surfaces 116 at points of contact such that surface tension is generated across the fluid. In the exemplary embodiment shown, the outer perimeter of a volume of fluid passing through fluid ejection device 100 may adhere to fluid control surfaces 116 such that, as the bulk of the fluid volume continues to advance downwardly due to the effects of gravity, the outer periphery of the volume of fluid experiences a drag force such that a meniscus M is formed. Although the meniscus M is shown in FIG. 4A as being concave, the meniscus may have a convex formation depending on the liquid-control surface interface.

In this regard, fluid control surfaces 116 impart the fluid with a capillary action to at least partially counteract the weight of fluid passing through fluid reservoir 110 such that the speed, e.g., the flow rate, of fluid passing through interior fluid channel 114 may be slowed. Accordingly, fluid control surfaces 116 may exert backpressure on a fluid passing through fluid reservoir 110 as a degree of control on a fluid that is to be ejected from fluid ejection device 110. For example, fluid control surfaces 116 may minimize or prevent a fluid passing through interior fluid channel 114 from undesired behavior, such as drooling or dripping, before deliberate ejection by fluid chip 130, as described further herein. Such a measure of control by fluid control surfaces 116 on fluids passing through fluid reservoir 110 may contribute to minimizing waste with respect to fluids used with fluid ejection device 100 (FIG. 1).

Figure 4B:
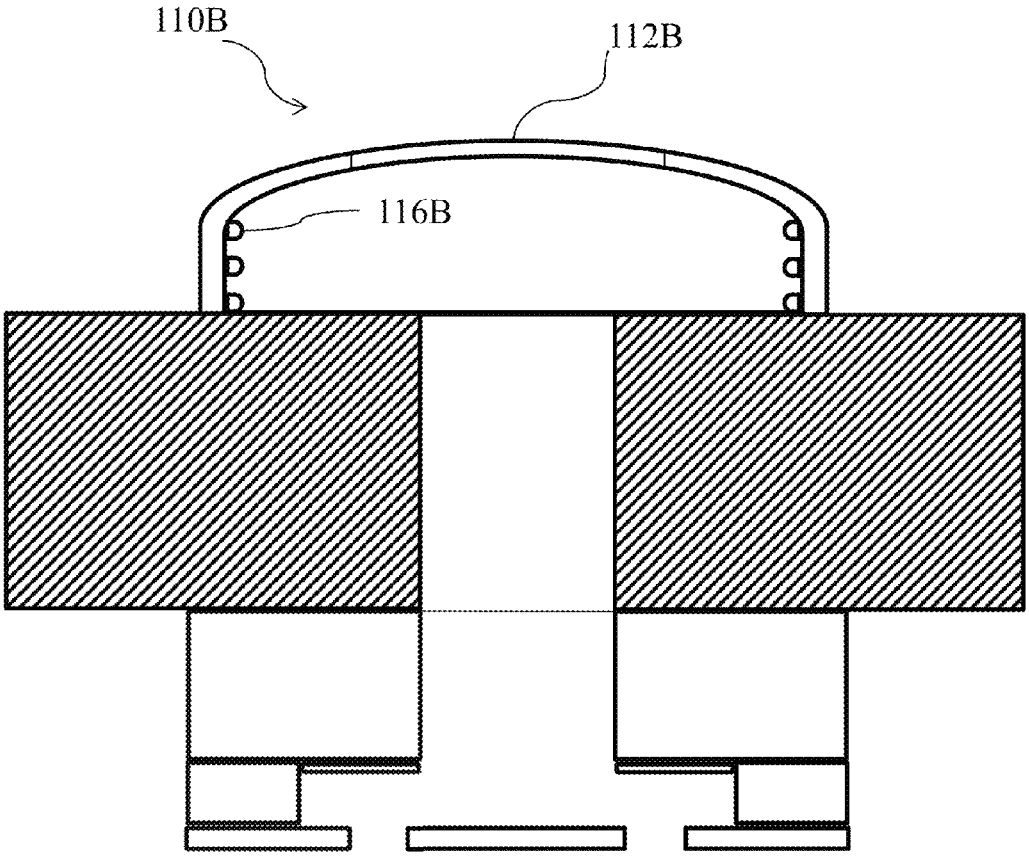
FIG. 4B is an enlarged cross-sectional view taken along the line A-A in FIG. 3 according to an exemplary embodiment of the present invention.

Turning now to FIG. 4B, an alternative embodiment of the present invention is illustrated in cross-section, in which a number of fluid control surfaces 116B are disposed along the interior surface of an annular wall 112B of a fluid reservoir 110B. As shown, fluid control surface 116B have a curvate, e.g., rounded or dome-shaped, cross-sectional profile.

Figure 4C:
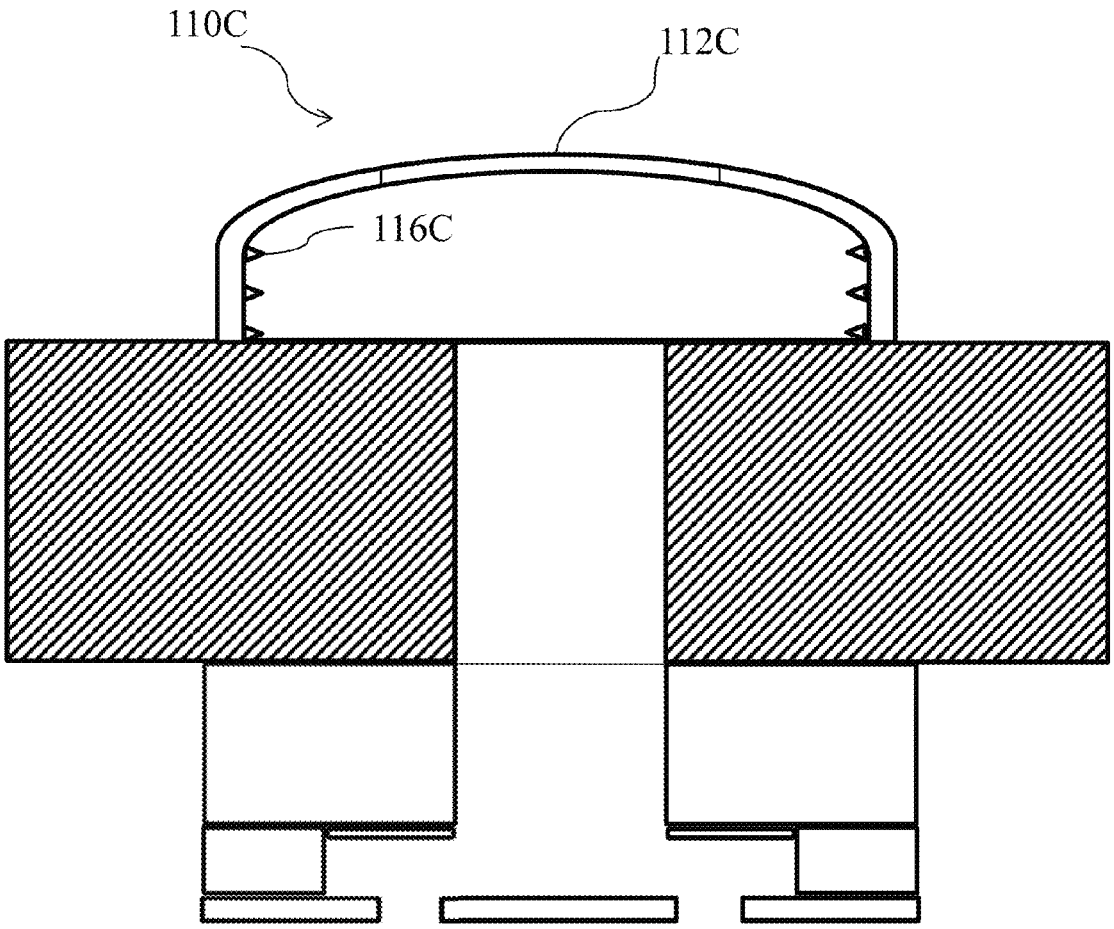
FIG. 4C is an enlarged cross-sectional view taken along the line A-A in FIG. 3 according to an exemplary embodiment of the present invention.

Referring to FIG. 4C, another alternative embodiment of the present invention is illustrated, in which a number of fluid control surfaces 116C are disposed along the interior surface of an annular wall 112C of a fluid reservoir 110C. As shown, fluid control surfaces 116C have a pointed, e.g., wedge-shaped or triangular-shaped, cross-sectional profile.

Figure 4D:
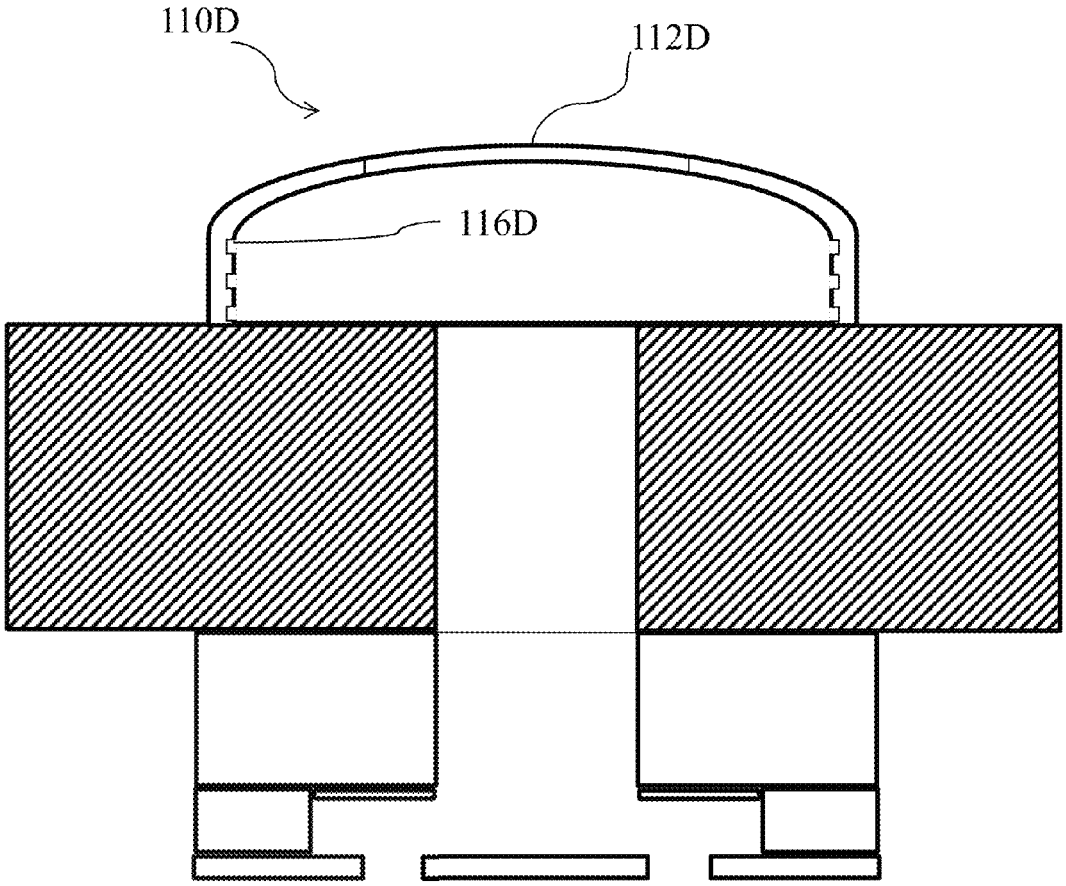
FIG. 4D is an enlarged cross-sectional view taken along the line A-A in FIG. 3 according to an exemplary embodiment of the present invention.

Turning to FIG. 4D, another alternative embodiment of the present invention is illustrated, in which a number of fluid control surfaces 116D are disposed along the interior surface of an annular wall 112D of a fluid reservoir 110D. As shown, engaging surfaces 116C have an upwardly turned hook-shaped cross-sectional profile.

Figure 4E:
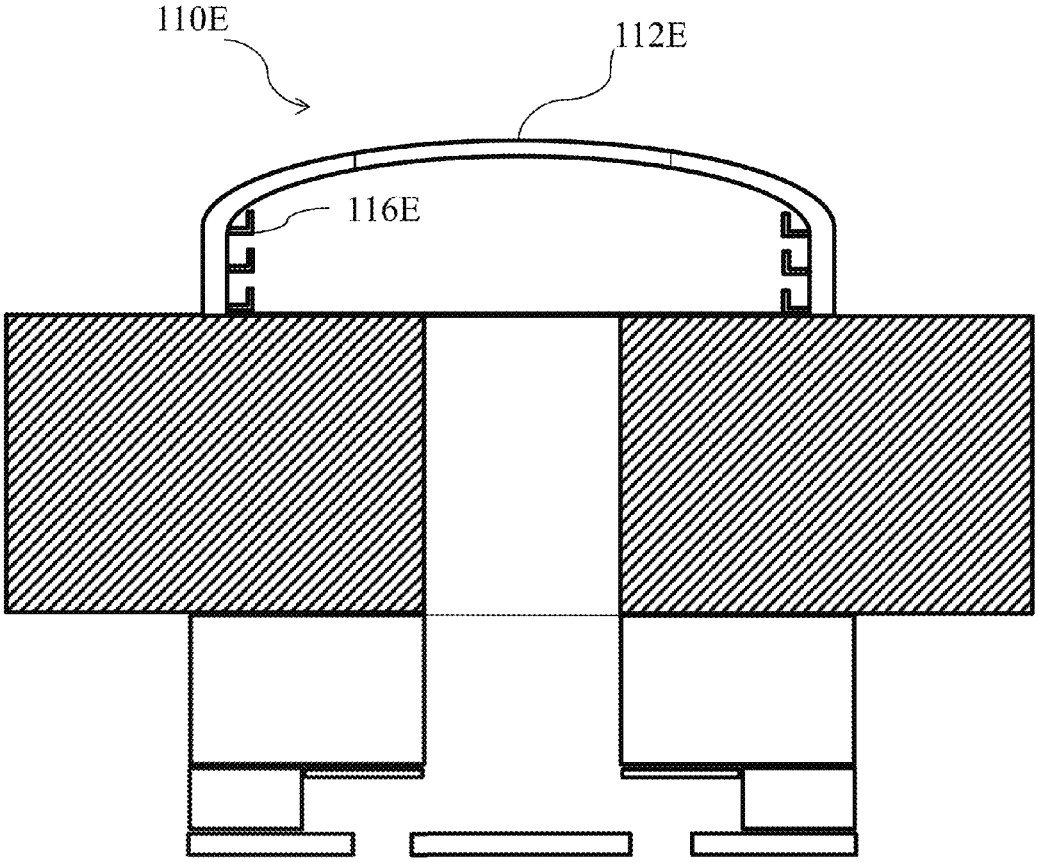
FIG. 4E is an enlarged cross-sectional view taken along the line A-A in FIG. 3 according to an exemplary embodiment of the present invention.

Referring to FIG. 4E, an alternative embodiment of the present invention is illustrated, in which a number of fluid control surfaces 116E are formed along the annular wall 112E of a fluid reservoir 110E. As shown, fluid control surfaces 116E do not protrude into the interior fluid path 114E of fluid reservoir 110E, but instead are recessed within the annular wall 112E of fluid reservoir 110E, e.g., by cutting or through inset molding of fluid reservoir 110E.

It will be understood that fluid reservoirs described herein in embodiments of the present invention may have different surface configurations, e.g., shape, texture, and/or material composition, such that a desired amount of backpressure is provided to a fluid passing therethrough. In embodiments, fluid control surfaces disposed along a fluid reservoir may have a different configuration, for example, a jagged, barbed, ridged, ribbed, or knurled cross-sectional profile, to name a few. In embodiments, fluid control surfaces disposed along a fluid reservoir may be continuous or may have one or more discontinuities therealong. In embodiments, a fluid reservoir may be treated, e.g., lined or coated, with a material to provide a desired flow rate of fluid passing therethrough, for example, a hydrophilic material. In embodiments, a fluid reservoir may contain additional fluid control surfaces, for example, a lip, ridge, and/or adhesive seam formed along the location at which the fluid reservoir and a fluid ejection device body meet.

Referring back to FIG. 4A, body 102 of fluid ejection device 100 includes an interior bore 108 upon which fluid reservoir 110 is disposed so that a fluid path is formed between the interior fluid channel 114 of the fluid reservoir 110 and the interior bore 108 of the body 102. As shown, interior bore 108 may have a similar diameter to the interior diameter of the widest portion of fluid reservoir 110, for example, between about 15 mm and about 25 mm. In embodiments, interior bore 108 may have a different diameter.

Fluid ejection chip 130 may be mounted to body 102 in a suitable fashion, for example, adhesion, molding, or ultrasonic welding. In this regard, fluid ejection device 100 can be assembled by providing body 102 having fluid reservoir 110 and attaching fluid ejection chip 130 to a portion of body 102 such that an interior fluid path of the fluid ejection chip 130 is in fluid communication with the interior bore 108 of the body 102 to provide a substantially open fluid path.

Fluid ejection chip 130 may include a substrate 140, a plurality of fluid ejector elements 150, a flow feature layer 160, and/or a nozzle layer 170. In embodiments, ejection chip 130 may have a different configuration.

Substrate 140 may be formed of semiconductor and/or insulator materials, for example, silicon, silicon dioxide, sapphire, germanium, gallium arsenide, and/or indium phosphide, to name a few. A portion of the substrate 140 may be processed to form one or more fluid channels 144 in fluid communication with the interior bore 108 of body 102. As described herein, processing portions of a fluid ejection chip may include, for example, mechanical deformation such as grinding, chemical etching, or patterning desired structures with photoresist, to name a few.

One or more ejector elements 150 may be disposed on the substrate 110. Ejector elements 150 may be comprised of one or more conductive and/or resistive materials so that when electrical power is supplied to the ejector elements 150, heat is caused to accumulate on and/or near the ejector elements 150 to eject fluid therefrom, as described further herein. In this regard, ejector elements 150 may be configured as thermal ejection actuators. In embodiments, ejector elements 150 may be formed of more than one layered material, such as a heater stack that may include a resistive element, dielectric, and protective layer. The amount of heat generated by ejector elements 150 may be directly proportional to the amount of power supplied to the ejector elements 150. In embodiments, power may be supplied to ejector elements 150 such that a predetermined thermal profile is generated by ejector elements 150, for example, a series of electrical power pulses of constant or variable amplitude and/or duration to achieve intended performance. In embodiments, ejector elements 150 may have a different electrical power configuration, for example, with the use of a piezoelectric element. In embodiments, an ejector element having a different configuration may be used with fluid ejection chip 130, for example, an ejector element that ejects fluid through the transfer of kinetic energy such as an electroactive polymer (EAP).

A flow feature layer 160 may be disposed over the substrate 140. Flow feature layer 160 may be disposed in a layered or otherwise generally planar abutting relationship with respect to substrate 140. Flow feature layer 160 may be formed of, for example, a polymeric material. Flow feature layer 160 may be processed such that one or more flow features 162 are formed along and/or within flow feature layer 160. In embodiments, flow features 162 may have geometry and/or dimensioning so that flow features 162 are configured to direct the flow of fluid through fluid ejection chip 130.

A nozzle layer 170 may be disposed over the flow feature layer 160. In embodiments, nozzle layer 170 may be disposed in a layered relationship with flow feature layer 160. In embodiments, nozzle layer 170 may be formed of, for example, a polymeric material. Nozzle layer 170 may be processed such that nozzles 172 are provided along an exposed surface of nozzle layer 170 as exit apertures for fluid being ejected from fluid ejection chip 130. Accordingly, nozzles 172 may have geometry and/or dimensioning configured to direct the trajectory of fluid exiting fluid ejection chip 130. Accordingly, fluid ejection chip 130 has an interior fluid volume for accommodating fluid. The various features of fluid ejection chip 130 described herein can be processed in a way so that a desired interior fluid volume is achieved.

Respective fluid channels 144, flow features 162, and/or nozzles 172 may collectively form one or more fluid paths within fluid ejector chip 130, such as fluid path $F_1$ and fluid path $F_2$ as shown, such that fluids can move from fluid reservoir 110, through fluid ejection chip 130, and exit through nozzles 172. As described herein, fluid paths $F_1$ and $F_2$ are substantially open such that the opportunity of fluids to pool, trap, or otherwise become blocked is substantially minimized. Accordingly, the fluid channel 114 of fluid reservoir 110 and the interior bore 108 of body 102, together with fluid paths $F_1$ and $F_2$, provide a substantially linear and open path through which fluids can flow so that substantially all of a fluid deposited into fluid reservoir 110 is ejected through nozzles 172. Further, by providing a fluid reservoir 110 having a desired interior volume, fluid ejector chip 130 can be provided such that a predetermined, discrete quantity of fluid is ejected onto a target surface while minimizing fluid waste due to the substantially linear and open fluid path provided by the interior configuration of fluid ejector chip 130.

Fluid ejection device 100 as described herein is suitable for use with, for example, relatively small quantities of fluid and accordingly may have a compact configuration. In this regard, fluid ejection device 100 may minimize manufacturing time and costs such that fluid ejection device 100 can be produced as a disposable device, e.g., a one-time use device. It may be desirable to use a disposable printhead design in a number of fields of application, for example, medical and laboratory testing, for example, to avoid sample contamination.

Figure 5:
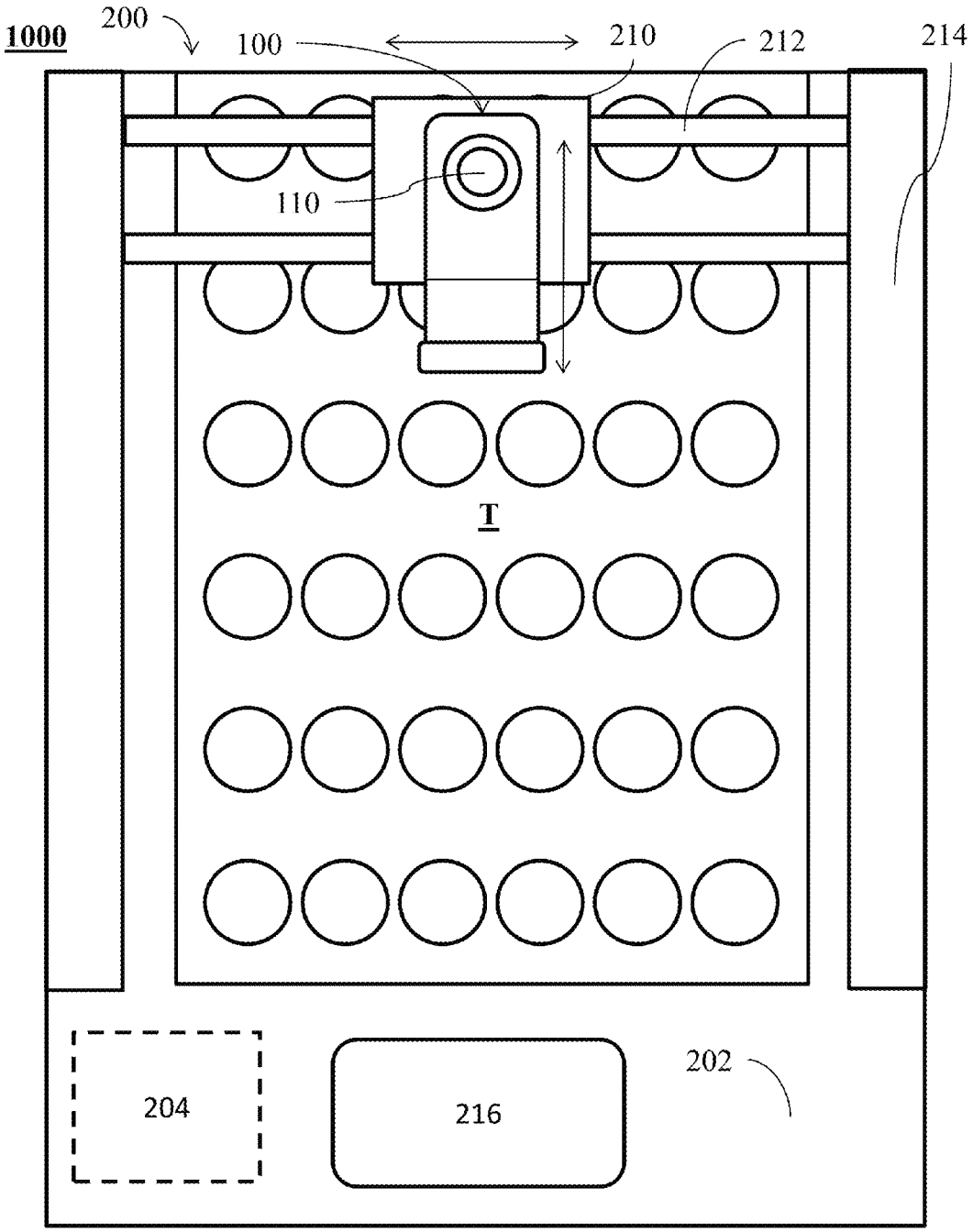
FIG. 5 is a top view of a fluid ejection system including the fluid ejection device of FIG. 1 according to an exemplary embodiment of the present invention.

Turning now to FIG. 5, a fluid ejection system according to an exemplary embodiment of the present invention is generally designated 1000. Fluid ejection system 1000 includes a fluid ejection printer 200 which is configured to receive at least a portion of fluid ejection device 100. In embodiments, fluid ejection printer 200 may receive a differently-configured fluid ejection device. Also shown is a testing surface T which may be, for example, a group of test tubes or an array of recessed reservoirs into which fluid can be deposited. In embodiments, testing surface T may be, for example, a testing slide or petri dish. In embodiments, testing surface T may be provided on a portion of fluid ejection printer 200.

Fluid ejection printer 200 includes a housing 202 and at least one carrier 210 for receiving a portion of fluid ejection device 100. In this regard, carrier 210 may include an interior recess for receiving a portion of fluid ejection device 100 and/or may present a surface suitable for coupling with fluid ejection device 100, for example, a clip, clamp, or tab structure, to name a few.

Carrier 210 may also include an electrically conductive portion (not shown) for contacting and supplying electrical power through the electrical connector 120 (FIG. 3) of fluid ejection device 100, e.g., from an internal power source or an electrical power supply line. In this regard, carrier 210 provides a physical and electrical interface between fluid ejection device 100 and fluid ejection printer 200.

In embodiments, carrier 210 may be movable with respect to fluid ejection printer 200 along a series of rails with which carrier 210 is directly and/or indirectly slidable. As shown, carrier 210 may be slidably movable along a pair of lateral rails 212, which are each in turn slidably movable along a pair of lengthwise rails 214. In this regard, carrier 210 may be movable along a two-dimensional plane parallel to the testing surface T, e.g., an x-y grid Fluid ejection printer 200 may also include a controller 204 for effecting various electrically-powered functions, for example, firing of ejection actuators 150 (FIG. 4) of fluid ejection device 100. Accordingly, controller 204 may include or be electronically coupled with one or more processors that can read instructions from non-transitory computer memory. Electrically powered functions of fluid ejection printer 200 may be actuated manually by a user through an interface 216, which may be, for example, knobs, toggles, and/or capacitive touchscreens, to name a few.

Referring to FIGS. 4A and 5, in use, a user may insert or otherwise mount fluid ejection device 100 to carrier 210 of fluid ejection printer 200. A quantity of fluid may then be deposited into the fluid reservoir 110 of fluid ejection device 100, for example, with a pipette or dropper. In embodiments, a quantity of fluid may be deposited into fluid reservoir 110 by an automated device, for example, a portion of fluid ejection printer 200. The quantity of fluid that can be accommodated in fluid ejection device 100 depends upon the interior volume of the fluid reservoir 110, the volume of the interior bore 108 of body 102, and the interior volume of the fluid ejection chip 130.

Upon depositing fluid into the fluid ejection device 100, one or more electrical power pulses can be provided to fluid actuators 150 to cause flash vaporization and ejection of droplets of fluid from nozzles 172.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid ejection device comprising:

a body defining an interior bore, the body comprising an engagement portion providing for a grasping engagement in mounting the fluid ejection device to a carrier;

a fluid reservoir comprising:

an opening that receives, upon the fluid ejection device being mounted to the carrier, a predetermined, discrete quantity of fluid, a vertical side wall, and one or more fluid control surfaces disposed along an interior surface of the vertical side wall, the fluid reservoir defining an interior passage in fluid communication with the interior bore of the body; and a fluid ejection chip disposed on the body and comprising one or more fluid ejection actuators, the fluid ejection chip having one or more interior fluid paths in fluid communication with the interior bore of the body so that the fluid ejection chip ejects fluid from the predetermined, discrete quantity of fluid upon activation of the one or more fluid ejection actuators;

wherein the interior passage of the fluid reservoir, the interior bore of the body, and the one or more interior fluid paths are axially aligned such that the predetermined, discrete quantity of fluid is gravity fed to the fluid ejection chip upon entry into the interior passage of the fluid reservoir;

wherein the one or more fluid control surfaces are disposed along the interior surface of the vertical side wall so as to exert a drag force on the predetermined, discrete quantity of fluid to form a meniscus;

wherein the opening of the fluid reservoir remains open and accessible to atmospheric air during an operation of the fluid ejection chip ejecting the fluid from the predetermined, discrete quantity of fluid, and wherein the engagement portion further provides for a grasping engagement in dismounting and discarding the fluid ejection device from the carrier upon completing an operation of the fluid ejection chip ejecting the fluid from the predetermined, discrete quantity of fluid.

2. The fluid ejection device of claim 1, wherein the one or more fluid control surfaces protrude from the vertical side wall of the fluid reservoir, the vertical side wall being an annular wall.

3. The fluid ejection device of claim 1, wherein the one or more fluid control surfaces are recessed into the annular wall of the fluid reservoir.

4. The fluid ejection device of claim 1, wherein the one or more fluid control surfaces have a cross-sectional profile selected from the group comprising: rounded rectangular, curvate, pointed, and hook-shaped.

5. The fluid ejection device of claim 1, wherein a surface of the annular wall of the fluid reservoir is coated with a hydrophilic substance.

6. The fluid ejection device of claim 1, wherein at least a portion of the fluid reservoir protrudes from the body.

7. The fluid ejection device of claim 1, wherein the one or more fluid ejection actuators are thermal ejection actuators.

8. The fluid ejection device of claim 1, wherein the fluid ejection chip comprises a substrate, a flow feature layer disposed over the substrate, and a nozzle layer disposed over the flow feature layer.

9. The fluid ejection device of claim 1, wherein the fluid ejection chip comprises a nozzle layer defining one or more nozzles.

10. The fluid ejection device of claim 1, wherein the fluid reservoir widens in the direction of the body.

11. The fluid ejection device of claim 1, wherein the one or more interior fluid paths are substantially linear.

12. The fluid ejection device of claim 1, wherein the body comprises a surface feature for engagement by a user.

13. A fluid ejection system, comprising:

a fluid ejection printer comprising:

a housing;

at least one of an internal power source or one or more electrical contacts in electrical communication with an external power source; and a carrier for coupling with one or more fluid ejection devices, the one or more fluid ejection devices each comprising:

a body defining an interior bore, the body comprising an engagement portion providing for a grasping engagement in mounting the fluid ejection device to the carrier;

a fluid reservoir comprising an opening that receives, upon the fluid ejection device being mounted to the carrier, a predetermined, discrete quantity of fluid, a vertical side wall, and one or more fluid control surfaces disposed along an interior surface of the vertical side wall, the fluid reservoir defining an interior passage in fluid communication with the interior bore of the body;

a fluid ejection chip coupled with the body and comprising one or more fluid ejection actuators, the fluid ejection chip having one or more interior fluid paths in fluid communication with the interior bore of the body so that the fluid ejection chip ejects fluid from the predetermined, discrete quantity of fluid upon activation of the one or more fluid ejection actuators; and an electrical connector in electrical communication with the fluid ejection printer so that power is supplied from the fluid ejection printer to the fluid ejection chip, wherein the engagement portion further provides for a grasping engagement in dismounting and discarding the fluid ejection device from the carrier upon completing an operation of the fluid ejection chip ejecting the fluid from the predetermined, discrete quantity of fluid;

wherein the interior passage of the fluid reservoir, the interior bore of the body, and the one or more interior fluid paths are axially aligned such that the predetermined, discrete quantity of fluid is gravity fed to the fluid ejection chip upon entry into the interior passage of the fluid reservoir;

wherein the one or more fluid control surfaces are disposed along the interior surface of the vertical side wall so as to exert a drag force on the predetermined, discrete quantity of fluid to form a meniscus; and wherein the opening of the fluid reservoir remains open and accessible to atmospheric air during an operation of the fluid ejection chip ejecting the fluid from the predetermined, discrete quantity of fluid.

14. The fluid ejection system of claim 13, wherein the fluid ejection printer comprises a carrier for coupling with the fluid ejection device.

15. The fluid ejection system of claim 14, wherein the carrier is moveable with respect to the housing of the fluid ejection printer.

16. The fluid ejection system of claim 13, wherein the fluid ejection printer comprises a controller.

17. A method of forming a fluid ejection device, comprising:

providing an elongate body defining an interior bore and comprising an engagement portion and an ejection portion, the ejection portion comprising a fluid reservoir extending at least partially through the body and defining an interior fluid channel in fluid communication with the interior bore of the body, the fluid reservoir comprising an annular wall and one or more fluid control surfaces disposed along an interior surface of the annular wall; and attaching a fluid ejection chip to the body so that an interior fluid path of the fluid ejection chip is axially aligned with and in fluid communication with the interior bore of the body and the interior fluid channel of the fluid reservoir.

18. The method of claim 17, wherein the fluid ejection chip comprises one or more fluid ejection actuators.

19. The method of claim 18, wherein the one or more fluid ejection actuators are thermal ejection actuators.

20. The method of claim 17, wherein the one or more fluid control surfaces have a cross-sectional profile selected from the group comprising: rounded rectangular, curvate, pointed, and hook-shaped.

* * * * *